US009869515B2

(12) United States Patent
Björklund et al.

(10) Patent No.: US 9,869,515 B2
(45) Date of Patent: Jan. 16, 2018

(54) SUSPENSION SMELTING FURNACE AND A CONCENTRATE BURNER

(75) Inventors: Peter Björklund, Espoo (FI); Kaarle Peltoniemi, Espoo (FI); Mikael Jåfs, Espoo (FI); Tapio Ahokainen, Helsinki (FI); Kari Pienimäki, Espoo (FI); Lauri P. Pesonen, Helsinki (FI)

(73) Assignee: Outotec Oyj, Espoo (FI)

( * ) Notice: Subject to any disclaimer, the term of this patent is extended or adjusted under 35 U.S.C. 154(b) by 396 days.

(21) Appl. No.: 13/807,211

(22) PCT Filed: Jun. 28, 2011

(86) PCT No.: PCT/FI2011/050614
§ 371 (c)(1),
(2), (4) Date: Dec. 27, 2012

(87) PCT Pub. No.: WO2012/001238
PCT Pub. Date: Jan. 5, 2012

(65) Prior Publication Data

US 2013/0099431 A1 Apr. 25, 2013

(30) Foreign Application Priority Data

Jun. 29, 2010 (FI) ..... 20105741

(51) Int. Cl.
*F27B 1/02* (2006.01)
*F27D 3/00* (2006.01)
(Continued)

(52) U.S. Cl.
CPC ..... *F27B 1/02* (2013.01); *C22B 15/0047* (2013.01); *F27B 19/04* (2013.01); *F27D 3/0025* (2013.01); *F27D 9/00* (2013.01)

(58) Field of Classification Search
CPC ..... C22B 15/0047; F27B 19/04; F27B 1/02; F27D 9/00; F27D 3/0025; F27D 3/18
(Continued)

(56) References Cited

U.S. PATENT DOCUMENTS 5,133,801 A * 7/1992 Saarinen ..... 75/707
5,362,032 A * 11/1994 Ranki ..... 266/182
(Continued)

FOREIGN PATENT DOCUMENTS

CN 1291043 C 12/2006
EP 1153254 B1 8/2004
(Continued)

OTHER PUBLICATIONS

Korean Patent Office Notice of Grounds for Rejection for corresponding Korean Patent Application No. 2012-7034276, 5 pgs, and English translation of Grounds for Rejection, 4 pgs.
(Continued)

*Primary Examiner* — Jessee Roe
*Assistant Examiner* — Michael Aboagye
(74) *Attorney, Agent, or Firm* — Chernoff, Vilhauer LLP

(57) ABSTRACT

The invention relates to a suspension smelting furnace comprising a reaction shaft (1), an uptake shaft (2), and a lower furnace (3), as well as a concentrate burner (4) for feeding reaction gas and fine solids into the reaction shaft (1) of the suspension smelting furnace. The concentrate burner (4) comprises a fine solids discharge channel (5) that is radially limited by the wall (6) of the solids discharge channel, a fine solids dispersion device (7) in the fine solids discharge channel (5), an annular reaction gas channel (8) that surrounds the fine solids discharge channel (5) and is radially limited by the wall (9) of the annular reaction gas channel (8), and a cooling block (10) that surrounds the annular reaction gas channel (8). The cooling block (10) is
(Continued)

Figure 1:
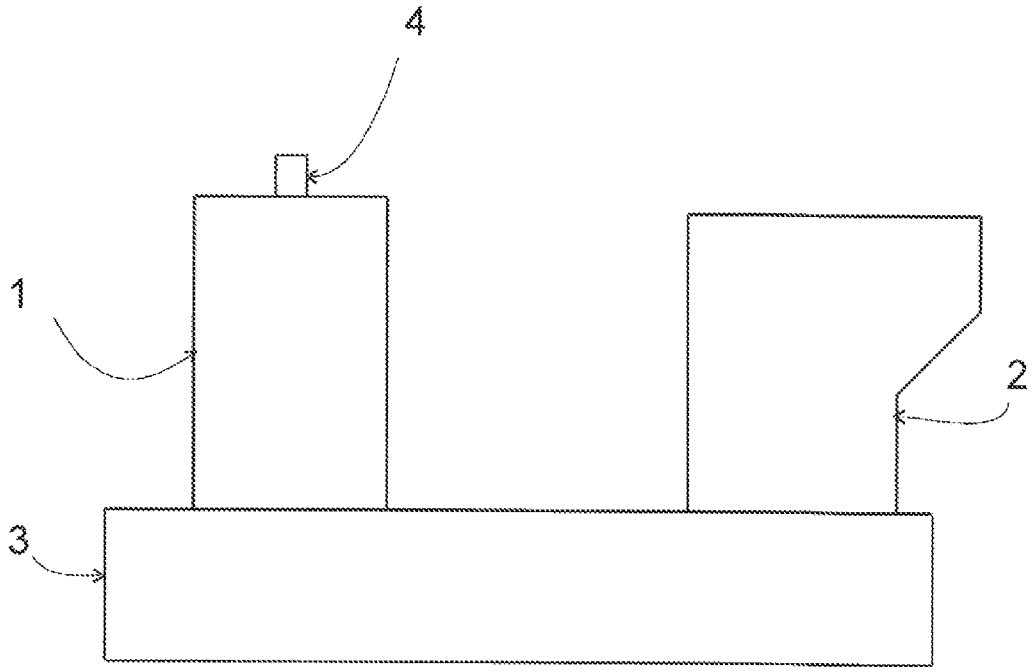

a component that is manufactured by a continuous casting method. The cooling block (10) is attached to the arch (11) of the reaction shaft (1) and the wall (9) of the annular reaction gas channel (8), so that the discharge orifice (12) of the annular reaction gas channel (8) is formed between a structure (13), which is jointly formed by the cooling block (10) and the wall (9) of the annular reaction gas channel (8), and the wall (6) of the solids discharge channel. The invention also relates to a concentrate burner (4) for feeding reaction gas and fine solids into the reaction shaft (1) of a suspension smelting furnace.

8 Claims, 2 Drawing Sheets

(51) Int. Cl.

| | |
|---|---|
| ***F27D 9/00*** | (2006.01) |
| ***C22B 15/00*** | (2006.01) |
| ***F27B 19/04*** | (2006.01) |

(58) Field of Classification Search
USPC ... 266/44, 176, 200, 266, 265, 47, 221, 267; 75/455
See application file for complete search history.

(56) References Cited

U.S. PATENT DOCUMENTS

| | | | | |
|---|---|---|---|---|
| 5,565,016 | A | 10/1996 | Hanniala et al. | |
| 5,674,310 | A * | 10/1997 | Miralles et al. | 75/707 |
| 6,238,457 | B1 * | 5/2001 | Holmi et al. | 75/455 |
| 6,988,935 | B2 * | 1/2006 | Shiraishi | B08B 9/057 451/102 |
| 8,206,643 | B2 * | 6/2012 | Sipila et al. | 266/175 |
| 2009/0205543 | A1 | 8/2009 | Schmeler et al. | |

FOREIGN PATENT DOCUMENTS

| | | | |
|---|---|---|---|
| FI | 26694 | | 9/1948 |
| JP | H07138666 | A | 5/1995 |
| JP | 2001-501294 | | 1/2001 |
| JP | 2002-533649 | | 10/2002 |
| JP | 2002532673 | A | 10/2002 |
| JP | 2007046120 | A | 2/2007 |
| JP | 2009162401 | A | 7/2009 |
| WO | 91/10105 | A1 | 7/1991 |
| WO | 98/14741 | | 4/1998 |
| WO | 9814741 | A1 | 4/1998 |
| WO | 98/30345 | | 7/1998 |
| WO | 00/37870 | A1 | 6/2000 |
| WO | 03089863 | A1 | 10/2003 |
| WO | 2008/037836 | A1 | 4/2008 |
| WO | 2009120858 | A1 | 10/2009 |

OTHER PUBLICATIONS

International Search Report, PCT/FI2011/050614, completed Oct. 19, 2011, dated Nov. 7, 2011, 3 pages.
Chinese Office action for application No. 201180037393.8, dated May 9, 2014, 10 pages.
Japanese Office action for 2013-517422, dated Mar. 17, 2014, dated Apr. 1, 2014, 7 pages.
Office Action from corresponding Japanese patent Application No. 201180037393.8, dated Dec. 31, 2014, 7pgs.
Extended European Search Report prepared by the European Patent Office for EP11 80 0246; dated Mar. 3, 2017, 8 pages.

* cited by examiner

SUSPENSION SMELTING FURNACE AND A CONCENTRATE BURNER

CROSS-REFERENCE TO RELATED APPLICATION

This is a national stage application filed under 35 USC 371 based on International Application No. PCT/FI2011/050614 filed Jun. 28, 2011, and claims priority under 35 USC 119 of Finnish Patent Application No. 20105741 filed Jun. 29, 2010.

BACKGROUND OF THE INVENTION

The invention relates to a suspension smelting furnace comprising a reaction shaft, an uptake shaft, and a lower furnace, as well as a concentrate burner for feeding reaction gas and fine-grained solids into the reaction shaft of the suspension smelting furnace.

The invention also relates to a concentrate burner for feeding reaction gas and fine-grained solids into the reaction shaft of a suspension smelting furnace.

Publication WO 98/14741 discloses a method for adjusting the flow velocity of reaction gas and the dispersion air of powdery solids, when feeding reaction gas and fine-grained solids into the reaction shaft of a suspension smelting furnace for creating a controlled and adjustable suspension. Reaction gas is fed into the furnace around a fine-grained solids flow, the solids being distributed with an orientation toward the reaction gas by means of dispersion air. The flow velocity and discharge direction of the reaction gas to the reaction shaft are smoothly adjusted by means of a specially shaped adjusting member which moves vertically in the reaction gas channel and by means of a specially shaped cooling block, which surrounds the reaction gas channel and which is located on the arch of the reaction shaft. The velocity of reaction gas is adjusted to a suitable level, irrespective of the gas quantity, in the discharge orifice located on the lower edge of the reaction shaft arch, from where the gas is discharged into the reaction shaft, forming a suspension with the powdery material therein, and the amount of the dispersion air which is used to disperse the material is adjusted according to the supply of the powdery material. The publication also discloses a multi-adjustable burner.

One problem with this known solution is the high price of the cooling block. It is usually manufactured from copper by sand casting. Sand casting, as a method, often leads to problems in quality, and a large amount of copper is consumed in making the cooling block.

SHORT DESCRIPTION OF THE INVENTION

The object of the invention is to solve the problems which are mentioned above.

The object of the invention is achieved by a suspension smelting furnace.

The suspension smelting furnace comprises a reaction shaft, an uptake shaft, and a lower furnace, as well as a concentrate burner for feeding reaction gas and fine solids into the reaction shaft of the suspension smelting furnace. The concentrate burner of the suspension smelting furnace comprises a fine solids discharge channel that is radially limited by the wall of the fine solids discharge channel, a fine solids dispersion device in the fine solids discharge channel, and an annular reaction gas channel that surrounds the fine solids discharge channel and that is radially limited by the wall of the annular reaction gas channel. The concentrate burner of the suspension smelting furnace further comprises a cooling block that surrounds the annular reaction gas channel.

In the suspension smelting furnace according to the invention, the cooling block is a component that is manufactured using a continuous casting method and that is attached to the arch of the reaction shaft and to the wall of the annular reaction gas channel, so that the discharge orifice of the annular reaction gas channel is formed between a structure, which is jointly formed by the cooling block and the wall of the annular reaction gas channel, and the wall of the fine solids discharge channel.

The invention also relates to a concentrate burner.

The concentrate burner comprises a fine solids discharge channel that is radially limited by the wall of the fine solids discharge channel, a fine solids dispersion device in the fine solids discharge channel, and an annular reaction gas channel that surrounds the fine solid matter discharge channel and that is radially limited by the wall of the annular reaction gas channel. The concentrate burner further comprises a cooling block that surrounds the annular reaction gas channel.

The cooling block in the concentrate burner according to the invention, is a component that is manufactured using a continuous casting method and that is attached with respect to the wall of the annular reaction gas channel, so that the discharge orifice of the reaction gas channel is formed between the structure, which is jointly formed by the cooling block and the wall of the annular reaction gas channel, and the wall of the fine solids discharge channel.

Preferred embodiments of the invention are disclosed in the dependent claims.

An advantage of the continuously-cast cooling block, when compared for example, with the solution of the publication WO 98/14741, is that a great deal less raw material, such as copper, is consumed in the manufacture and that the manufacturing process is also considerably easier. The continuously-cast cooling block provides improved protection against corrosions, which cause leaks, than a sand-cast cooling block.

The simple structure of the cooling block makes it considerably easier to install accessories and measuring devices that measure the process close to the concentrate burner. In a preferred embodiment, openings are formed in the cooling block for the feed-through of an outgrowth removal arrangement, such as the feed-through of outgrowth removal arrangement pistons.

In one solution according to the invention, the cooling block comprises drilled channels with the purpose of circulating cooling fluid in the cooling block.

LIST OF FIGURES

Figure 2:
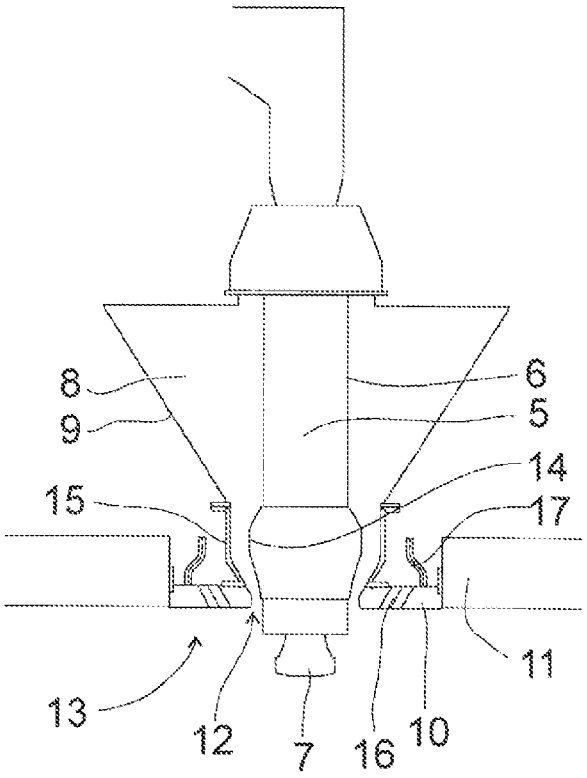
Figure 3:
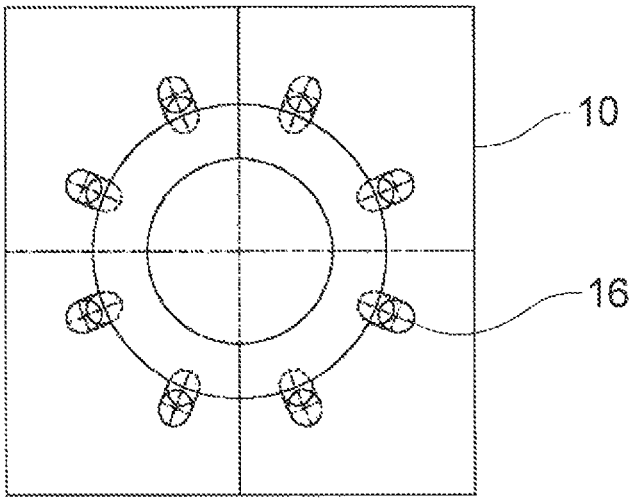

In the following, some preferred embodiments of the invention are described in detail with reference to the appended figures, wherein FIG. 1 shows the suspension smelting furnace;

FIG. 2 shows a vertical section of one preferred embodiment of the concentrate burner in a state, where the concentrate burner is installed in the reaction shaft of a suspension smelting furnace; and FIG. 3 shows a cooling block from above.

DETAILED DESCRIPTION OF THE INVENTION

The invention relates to the suspension smelting furnace and the concentrate burner.

First, the suspension smelting furnace and some of its preferred embodiments and variations are described in more detail.

FIG. 1 shows a suspension smelting furnace which comprises a reaction shaft 1, an uptake shaft 2, and a lower furnace 3, as well as a concentrate burner 4 for feeding reaction gas (not shown in the figures) and fine solids (not shown) into the reaction shaft 1. The operation of such a suspension smelting furnace is described in the Finnish patent FI22694, for example.

The concentrate burner 4 comprises a fine solids discharge channel 5, which is radially, that is outwardly limited by the wall 6 of the fine solids discharge channel 5.

The concentrate burner 4 comprises a fine solids dispersion device 7 in the fine solids discharge channel 5.

The concentrate burner 4 comprises an annular reaction gas channel 8, which surrounds the fine solids discharge channel 5 and which is radially limited by the wall 9 of the annular reaction gas channel 8.

The concentrate burner 4 comprises a cooling block 10 that surrounds the annular reaction gas channel 8.

The operation of such a concentrate burner 4 is described in the publication WO 98/14741, for example.

The cooling block 10 is a component that is manufactured using a continuous casting method.

The cooling block 10 is attached to the arch 11 of the reaction shaft 1 and to the wall 9 of the annular reaction gas channel 8, so that the discharge orifice 12 of the annular reaction gas channel 8 is formed between a structure 13, which is jointly formed by the cooling block 10 and the wall 9 of the annular reaction gas channel 8, and the wall 6 of the fine solids discharge channel 5.

The wall 6 of the fine solids discharge channel 5 preferably, but not necessarily, comprises a first curved portion 14 on the side of the annular reaction gas channel 8, which is adapted so as to work in cooperation with the second curved portion 15 of the structure 13 on the side of the annular reaction gas channel 8, which structure 13 is jointly formed by the cooling block 10 and the wall 9 of the annular reaction gas channel 8, so that the flow cross-sectional area of the annular reaction gas channel 8 decreases in the flow direction of the reaction gas between the first curved portion 14 and the second curved portion 15.

The wall 6 of the fine solids discharge channel and the structure 13 that is jointly formed by the cooling block 10 and the wall 9 of the reaction gas channel are preferably, but not necessarily, vertically movable with respect to each other, so that the size of the flow cross-sectional area of the discharge orifice 12 of the annular reaction gas channel 8 changes. For example, it is possible to vertically move the wall 6 of the fine solids discharge channel, so that the size of the flow cross-sectional area of the discharge orifice 12 of the reaction gas channel changes.

The annular reaction gas channel 8 can be provided with adjustable or fixed swirl vanes (not shown in the figures).

The cooling block 10 preferably, but not necessarily comprises channels 17, such as drilled channels for the purpose of circulating cooling fluid (not shown) in the cooling block 10.

The cooling block 10 is preferably, but not necessarily, provided with openings 16 for the feed-through of an outgrowth removal system (not shown).

The cooling block 10 is preferably, but not necessarily, at least partly manufactured of copper or a copper alloy.

The invention also relates to a concentrate burner 4 for feeding reaction gas and fine solids into the reaction shaft 1 of the suspension smelting furnace.

The concentrate burner 4 comprises a fine solids discharge channel 5, which is radially, that is outwardly limited by the wall 6 of the fine solids discharge channel 5.

The concentrate burner 4 comprises a fine solids dispersion device 7 in the fine solids discharge channel 5.

The concentrate burner 4 comprises an annular reaction gas channel 8, which surrounds the fine solids discharge channel 5 and which is radially, that is outwardly, limited by the wall 9 of the annular reaction gas channel 8.

The concentrate burner 4 comprises a cooling block 10 that surrounds the annular reaction gas channel 8.

The operation of such a concentrate burner 4 is described in the publication WO 98/14741, for example.

In the concentrate burner 4, the cooling block 10 is a component that is manufactured by the continuous casting method.

The cooling block 10 is attached to the wall 9 of the annular reaction gas channel 8, so that the discharge orifice 12 of the annular reaction gas channel 8 is formed between the structure 13, which is jointly formed by the cooling block 10 and the wall 9 of the annular reaction gas channel 8, and the wall 6 of the fine solids discharge channel 5.

The wall 6 of the fine solids discharge channel 5 preferably, but not necessarily, comprises a first curved portion 14 on the side of the annular reaction gas channel 8, which is adapted so as to work in cooperation with the second curved portion 15 of the structure 13 on the side of the annular reaction gas channel 8, which structure 13 is jointly formed by the cooling block 10 and the wall 9 of the annular reaction gas channel 8, so that the flow cross-sectional area of the annular reaction gas channel 8 decreases in the flow direction of the reaction gas between the first curved portion 14 and the second curved portion 15.

The wall 6 of the fine solids discharge channel 5 and the structure 13 that is jointly formed by the cooling block 10 and the wall 9 of the annular reaction gas channel 8 are preferably, but not necessarily, vertically movable with respect to each other, so that the size of the flow cross-sectional area of the annular reaction gas channel 8 discharge orifice 12 changes. For example, it is possible that the wall 6 of the fine solids discharge channel 5 is vertically movable, so that the size of the flow cross-sectional area of the discharge orifice 12 of the annular reaction gas channel 8 changes.

The annular reaction gas channel 8 can be provided with adjustable or fixed swirl vanes (not shown in the figures).

The cooling block 10 preferably, but not necessarily, comprises channels 17, such as drilled channels for the purpose of circulating cooling fluid (not shown) in the cooling block 10.

The cooling block 10 is preferably, but not necessarily, provided with openings 16 for the feed-through the outgrowth removal system (not shown).

The cooling block 10 is preferably, but not necessarily, at least partly manufactured of copper or a copper alloy.

It is obvious to those skilled in the art that with the technology improving, the basic idea of the invention can be implemented in various ways. Thus, the invention and its embodiments are not limited to the examples described above but they may vary within the claims.

The invention claimed is:

1. A suspension smelting furnace comprising a reaction shaft, an uptake shaft, and a lower furnace, as well as a concentrate burner for feeding of reaction gas and fine solids into the reaction shaft of the suspension smelting furnace, the concentrate burner comprising a fine solids discharge channel that is radially limited by the wall of the fine solids discharge channel;

a fine solids dispersion device in the fine solids discharge channel;

an annular reaction gas channel that surrounds the fine solids discharge channel and that is radially limited by the wall of the annular reaction gas channel; and a cooling block that surrounds the annular reaction gas channel, wherein the cooling block is a component that is manufactured using a continuous casting method;

wherein the cooling block is attached to the arch of the reaction shaft and to the wall of the annular reaction gas channel, so that the discharge orifice of the annular reaction gas channel is formed between a structure, which is jointly formed by the cooling block and the wall of the annular reaction gas channel, and the wall of the fine solids discharge channel, so that the discharge orifice of the annular reaction gas channel is radially outwardly limited by the structure, which is jointly formed by the cooling block and the wall of the annular reaction gas channel, and so that the discharge orifice of the annular reaction gas channel is radially inwardly limited by the wall of the fine solids discharge channel; and the cooling block is provided with through openings for a feed-though for an attached outgrowth removal system, said outgrowth removal system structurally connected to said through openings for removing outgrowth from the cooling block, wherein the cooling block comprises channels for the purpose of circulating cooling fluid in the cooling block, and wherein the through openings are not connected to the channels for the purpose of circulating cooling fluid in the cooling block.

2. The suspension smelting furnace according to claim 1, wherein the wall of the fine solids discharge channel comprises a first curved portion on the side of the annular reaction gas channel, and wherein the first curved portion is adapted to have congruence with and therefore cooperatively work with a second curved portion of the structure on the side of the reaction gas channel, which structure is jointly formed by the cooling block and the wall of the reaction gas channel, so that the flow cross-sectional area of the reaction gas channel decreases in the flow direction of the reaction gas between the first curved portion and the second curved portion.

3. The suspension smelting furnace according to claim 1, wherein the fine solids discharge channel is vertically movable, so that the size of the flow cross-sectional area of the discharge orifice of the annular reaction gas channel changes.

4. The suspension smelting furnace according to claim 1, wherein the cooling block is at least partly manufactured of copper or a copper alloy.

5. A concentrate burner for feeding reaction gas and fine solids into the reaction shaft of a suspension smelting furnace, comprising a fine solids discharge channel that is radially limited by the wall of the fine solids discharge channel;

a fine solids dispersion device in the fine solids discharge channel;

an annular reaction gas channel that surrounds the fine solids discharge channel and that is radially limited by the wall of the annular reaction gas channel;

a cooling block that surrounds the annular reaction gas channel;

wherein the cooling block is a component that is manufactured by a continuous casting method;

wherein the cooling block is attached to the wall of the annular reaction gas channel, so that the discharge orifice of the annular reaction gas channel is formed between a structure, which is jointly formed by the cooling block and the wall of the annular reaction gas channel, and the wall of the fine solids discharge channel, so that the discharge orifice of the annular reaction gas channel is radially outwardly limited by the structure, which is jointly formed by the cooling block and the wall of the annular reaction gas channel, and so that the discharge orifice of the annular reaction gas channel is radially inwardly limited by the wall of the fine solids discharge channel; and wherein the cooling block is provided with through openings for a feed-though for an attached outgrowth removal system, said outgrowth removal system structurally connected to said through openings for removing outgrowth from the cooling block, wherein the cooling block comprises channels for a cooling fluid, and wherein the through openings are not connected to the channels for the purpose of circulating cooling fluid in the cooling block.

6. The concentrate burner according to claim 5, wherein the wall of the fine solids discharge channel comprises a first curved portion on the side of the annular reaction gas channel, and wherein the first curved portion is adapted to have congruence with and therefore cooperatively work with a second curved portion of the structure on the side of the reaction gas channel, which structure is jointly formed by the cooling block and the wall of the annular reaction gas channel, so that the flow cross-sectional area of the annular reaction gas channel decreases in the flow direction of the reaction gas between the first curved portion and the second curved portion.

7. The concentrate burner according to claim 5, wherein the fine solids discharge channel is vertically movable, so that the size of the flow cross-sectional area of the discharge orifice of the annular reaction gas channel changes.

8. The concentrate burner according to claim 5, wherein the cooling block is at least partly manufactured of copper or a copper alloy.

* * * * *